US008322437B2

(12) United States Patent
Brey

(10) Patent No.: US 8,322,437 B2
(45) Date of Patent: Dec. 4, 2012

(54) METHOD AND SYSTEM FOR CONFINING AND SALVAGING OIL AND METHANE LEAKAGE FROM OFFSHORE LOCATIONS AND EXTRACTION OPERATIONS

(76) Inventor: Arden L. Brey, Orange Park, FL (US)

( * ) Notice: Subject to any disclaimer, the term of this patent is extended or adjusted under 35 U.S.C. 154(b) by 0 days.

(21) Appl. No.: 13/166,804

(22) Filed: Jun. 22, 2011

(65) Prior Publication Data

US 2011/0311311 A1 Dec. 22, 2011

Related U.S. Application Data

(60) Provisional application No. 61/357,338, filed on Jun. 22, 2010.

(51) Int. Cl.
*E21B 19/00* (2006.01)
*E21B 43/01* (2006.01)

(52) U.S. Cl. ..... 166/363; 166/344; 166/364; 166/79.1; 166/96.1; 166/97.1; 405/60; 405/225

(58) Field of Classification Search ..... 166/363, 166/339, 344, 351, 364, 285, 79.1, 81.1, 166/96.1, 97.1, 75.13, 177.4; 405/60, 224, 405/225, 233, 244, 256
See application file for complete search history.

(56) References Cited

U.S. PATENT DOCUMENTS 1,858,241 A * 5/1932 Giles ..... 166/95.1
3,548,605 A * 12/1970 Armistead et al. ..... 405/60
3,653,215 A * 4/1972 Crucet ..... 405/60
3,664,136 A * 5/1972 Laval et al. ..... 405/60
3,681,923 A * 8/1972 Hyde ..... 405/60
3,981,154 A * 9/1976 Hix, Jr. ..... 405/60
4,081,970 A * 4/1978 Dowse ..... 405/204
4,220,421 A * 9/1980 Thorne ..... 405/211
4,290,714 A * 9/1981 Strange ..... 405/60
4,318,442 A * 3/1982 Lunde et al. ..... 166/357
4,323,118 A * 4/1982 Bergmann ..... 166/96.1
4,324,505 A * 4/1982 Hammett ..... 405/60
4,358,218 A * 11/1982 Graham ..... 405/60
4,358,219 A * 11/1982 Burns ..... 405/60
4,373,834 A * 2/1983 Grace ..... 405/60
4,416,565 A * 11/1983 Ostlund ..... 210/170.11
4,421,436 A * 12/1983 Burns ..... 405/223.1
4,440,523 A * 4/1984 Milgram et al. ..... 210/170.11
4,456,071 A * 6/1984 Milgram ..... 166/356
4,568,220 A * 2/1986 Hickey ..... 405/60
5,050,680 A * 9/1991 Diehl et al. ..... 166/356
7,546,880 B2 * 6/2009 Zhang et al. ..... 166/358
7,674,073 B2 * 3/2010 Heskin et al. ..... 405/195.1
7,987,903 B1 * 8/2011 Prado Garcia ..... 166/75.13
8,016,030 B1 * 9/2011 Prado Garcia ..... 166/75.13
2011/0274496 A1 * 11/2011 Dvorak ..... 405/64

* cited by examiner

*Primary Examiner* — Matthew Buck
(74) *Attorney, Agent, or Firm* — Mark Young, PA

(57) ABSTRACT

A method of, and system for, collecting and controlling hydrocarbons leaking from offshore sea bottom environments entail providing a concrete containment barrier and catenary gasket around the leak source, pumping concrete onto the catenary gasket, opening ports and valves in a containment vessel while it is positioned over the leak source, at least partially embedding the containment vessel in the pumped concrete, closing the ports and valves to capture leaking fluids, and communicating the fluids to the surface for further processing. The modular containment barrier may be placed around an existing or potential well site, or an operating well, abandoned well or sea bottom fissure to facilitate implementation of the method in the event of a leak.

18 Claims, 15 Drawing Sheets

METHOD AND SYSTEM FOR CONFINING AND SALVAGING OIL AND METHANE LEAKAGE FROM OFFSHORE LOCATIONS AND EXTRACTION OPERATIONS

RELATED APPLICATION

This application is a nonprovisional of and claims the benefit of priority of U.S. Provisional Application 61/357,338 filed 22 Jun. 2010, the entire contents of which are incorporated herein by this reference and made a part hereof.

FIELD OF THE INVENTION

This invention relates generally to offshore oil and gas leaks, and, more particularly, to a method and system for confining and salvaging oil and methane leakage from offshore locations and extraction operations.

BACKGROUND

Off-shore oil exploration and drilling operations present potentially serious sources of water pollution. A break in a well casing at or near the ocean floor or a crack or fissure in the subterranean rock structure adjacent an existing well, due to pressure build-up, will often cause a serious oil and gas leakage which can be extremely difficult to control. In the past containment receptacles have been devised which cooperates with the sea bottom to provide a substantial enclosure around a source of leakage and which includes a means for pumping or otherwise removing oil or water contaminated with oil from the enclosure. A typical containment receptacle is shown in U.S. Pat. No. 3,681,923, to Hyde, which describes steps of collecting oil within an underwater receptacle located along the sea floor. The open-bottom receptacle overlies a leak. A conduit is connected to the receptacle. A concrete seal is lowered and placed along the sidewall of the containment vessel adjacent to the ocean floor.

U.S. Pat. No. 4,318,442 to Lunde, et al. describes a vessel with a lower weighted collar (i.e., base loop), that serves as ballast. Provided on the vessel are vent ports, a valve controlled chimney, a gas outlet positioned to provide a gas cap in the vessel when the valve is closed with the vessel in position around the blowing well, and an oil outlet above the vent ports and below the gas cap and means for pumping substantially only oil from the vessel at a rate to prevent oil from escaping from the vessel to the sea in substantial quantities.

U.S. Pat. No. 4,456,071 to Milgram describes a collector vessel for use with a blown-out seabottom wellhead. The vessel has a conical base with a flanged open bottom and a cylindrical riser extending from the top of the base. A loop-like level pad is installed about the wellhead. The flange of the vessel is attached to the pad by means of skirt piles. This forms a seal against leakage. The vessel includes a relief passage adapted to vent excess gas from the collector apparatus during initial stages of any blow-out. A valve in the relief passage allows the passage to be closed after the initial stages of any blow-out to limit escape of released oil. The vessel includes a drilling port adapted to allow drilling operations to proceed.

The prior art systems and methods do not effectively anchor the containment vessel into place. None of the prior art systems and methods teach or enable a containment vessel at least partially embedded in a concrete base. Likewise, none of the prior art systems and methods teach pumping concrete as part of the vessel installation process, or use of a loop-like frame in which the concrete base will be formed.

Additionally, the prior art systems and methods do not effectively accommodate an irregular seabed. The prior art may work well where the seabed is relatively planar or at least conforms to the shape of the containment vessel and ballast. However, non-planar, non-conforming seabeds cause gaps between ballast and the seabed or the containment vessel and the seabed. Such gaps are conducive to continued leakage.

Furthermore, the prior art systems and methods are not scalable or adaptable accommodate a wide range of leakage sources, such as fissures, a broken well pipe, a failed blowout preventer, a failed annular or other similar equipment. Instead, the prior art systems and methods are intended to address a particular leak source under particular conditions.

Moreover, the prior art systems and methods do not address pressure relief and removal of ice from the containment vessel during installation. Instead, the prior art systems and methods assume that the vessel may be positioned despite the extreme pressure exerted by the escaping fluid. The prior art systems and methods also do not provide means for evacuating ice formations from the interior of the containment vessel. Rapid expansion of escaping gasses (e.g., methane) causes ice formations, which can fill and/or clog a containment vessel, rendering it useless.

The invention is directed to overcoming one or more of the problems and solving one or more of the needs as set forth above.

SUMMARY OF THE INVENTION

To solve one or more of the problems set forth above, in an exemplary implementation of the invention, an improved method of, and system for, collecting and controlling hydrocarbons leaking from offshore sea bottom environments. An exemplary method includes steps of providing a concrete containment barrier around the leak source, pumping concrete, opening ports and valves in a containment vessel while it is positioned over the leak source, at least partially embedding a containment vessel in the pumped concrete, closing the ports and valves to capture leaking fluids, and communicating the fluids to the surface for further processing. An exemplary system includes a modular containment barrier to be placed around an existing or potential well site, or an operating well, abandoned well or sea bottom fissure; an adaptable containment vessel with various ports and valves that may be opened to relieve pressure and allow ice to escape and closed to capture leaking fluids; a pumped submarine concrete anchor and ballast into which the vessel is at least partially embedded; and an optional catenary gasket with a central aperture attached to the bottom of the containment barrier.

BRIEF DESCRIPTION OF THE DRAWINGS

The foregoing and others aspects, objects, features and advantages of the invention will become better understood with reference to the following description, appended claims, and accompanying drawings, where:

Figure 1:
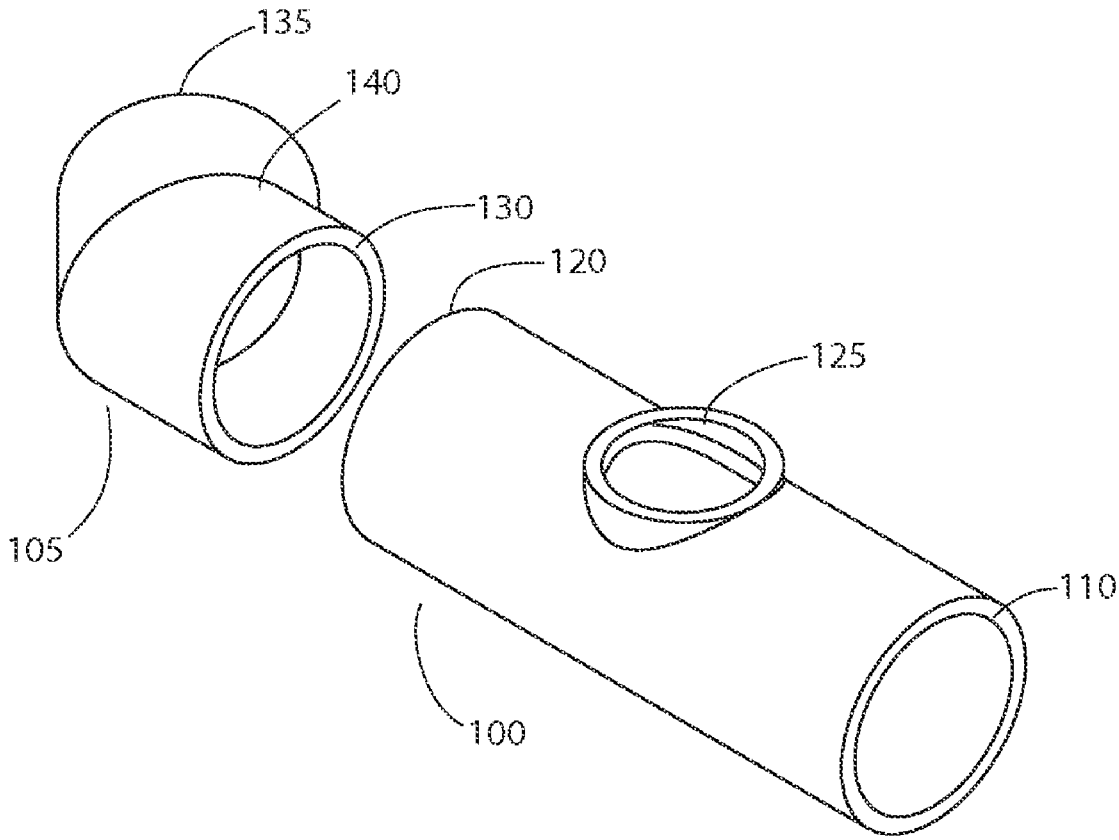
FIG. 1 is a top perspective view of an exemplary pipe and elbow for forming a concrete containment barrier according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the configurations, shapes, relative sizes, proportions, scales, or ornamental aspects shown in the figures.

DETAILED DESCRIPTION

An exemplary system according to principles of the invention includes three main components as well as optional and subsidiary components. A first main component is a rigid containment barrier capable of holding thousands of tons of concrete ballast, and providing structural reinforcement for a containment vessel. A second main component is a containment vessel capable of withstanding pressures of leaking hydrocarbon fluids materials. A third main component is a pumped concrete foundation that provides a stable base upon which a containment vessel may rest, anchors the containment vessel in place and partially encapsulates the exterior of the containment vessel. A fourth and optional component is a flexible catenary gasket providing a bottom surface that conforms to the seabed and upon which concrete is pumped. Additional components include client-specified fittings, incorporated into the containment vessel, enabling the system to be used with or incorporated as a part of the petroleum extraction process, as specified by the client.

The concrete base containment barrier comprises a concrete formwork placed upon the seabed. The containment barrier when placed on the seabed defines a mold into which concrete and/or similar materials are pumped.

As used herein, concrete broadly encompasses all cementitious materials, including hydraulic cement with and without each of the following: aggregate; reinforcements such as reinforcing bars; and chemical admixtures such as accelerators to speed up the hydration (hardening) of the concrete, retarders to slow the hydration of concrete, plasticizers to increase workability of the concrete, pigments to color the concrete, for easy identification, corrosion inhibitors to minimize the corrosion of any steel and steel bars in concrete, bonding agents to create a bond between separate layers (e.g., old and new) concrete, and pumping aids to improve pumpability, thicken the paste and reduce separation and bleeding. Additionally, as used herein, concrete also broadly encompasses concrete and cement substitutes such as: polymeric mortars, fly ash, slag, silica fume and ice hull ash. Hydraulic concrete, as used herein, means a concrete or concrete substitute formulated to solidify when submerged underwater.

The dimensions of the concrete containment barrier, in which hydraulic concrete is pumped, is to be specified by the hydrocarbon extraction company to accommodate a variety of components of the client's particular extraction operation. The containment barrier has an inner diameter that is greater than the outer diameter or maximum width of the surrounded containment vessel.

Figure 2:
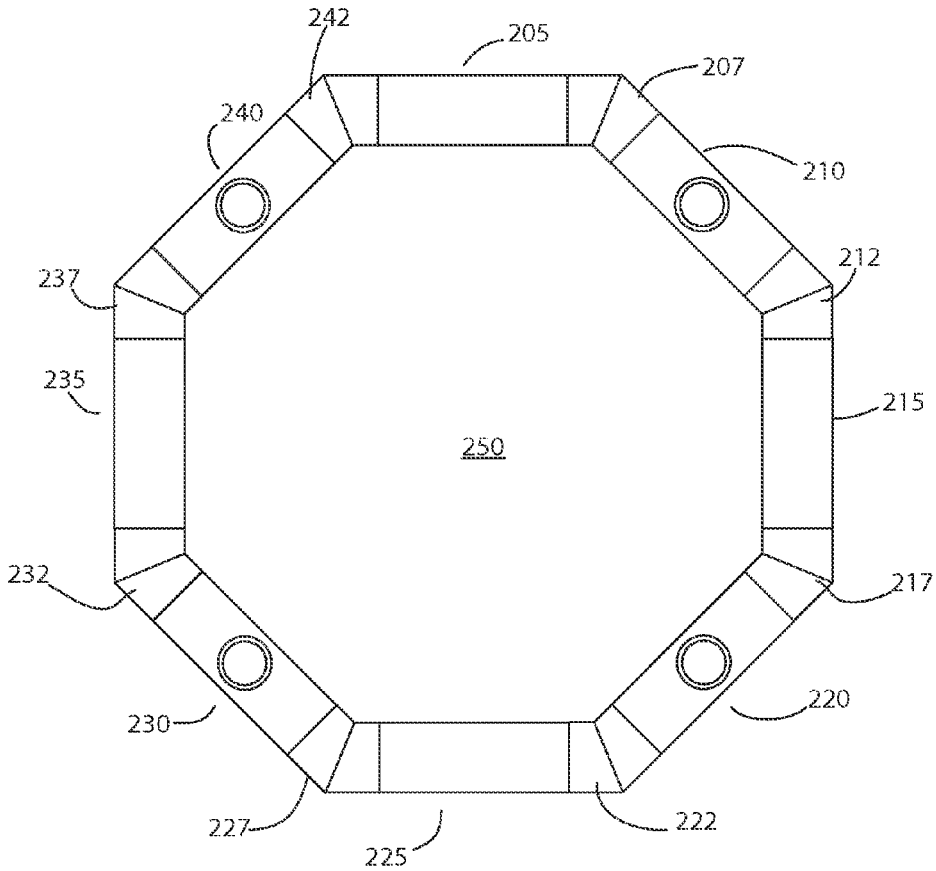
FIG. 2 is a plan view of an exemplary single level (i.e., single tier) of a concrete containment barrier according to principles of the invention.

In an exemplary embodiment, the containment barrier is comprised of a large diameter closed loop formed with segments of pressure resistant pipe that are welded together at an onshore site nearest to the deployment site, and transported by a crane barge to the site. By way of example and not limitation, an octagonal loop 250 as shown in FIG. 2 may be comprised of eight rigid pipe segments 205, 210, 215, 220, 225, 230, 235 and 240 coupled together with elbows 207, 212, 217, 222, 227, 232, 237 and 242. The pipe segments may be welded to the coupling elbows.

In a particular preferred embodiment, with reference to FIG. 1, each pipe segment 100 is a Tee-shaped segment with a port 125 transverse to the longitudinal axis of the pipe segment running from one end 110 to the opposite end 120. The outermost portion of the port 125 is approximately flush with the outer surface of the pipe segment 100. This facilitates stacking arrangement of the pipe segments without appreciable gaps between stacked segments. The exemplary pipe segment 100 is linear. The exemplary elbow 105 includes a first portion 130 and a second portion 135 joined together at a junction 140 at a determined angle (e.g., 45°). Thus, the angle of the longitudinal axis of the first segment 130 relative to that of the second segment 135 is about 45°.

Figure 3:
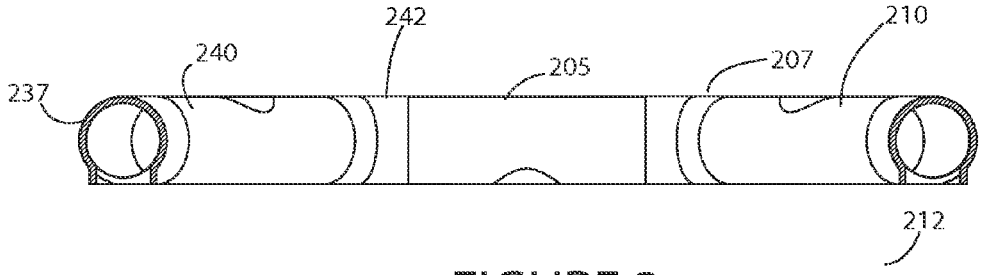
FIG. 3 is a section view of a portion of an exemplary single level of a concrete containment barrier according to principles of the invention.

The loop 250 is filled with a material such as concrete prior to use. With reference to FIGS. 2 and 3, the pipe segments of a loop are installed with the port 125 to alternately face upward and downward, so as to create vertical and horizontal pathways within tiers of stacked loops. Thus, in a multi-tier embodiment, concrete introduced into one tier may flow through ports to each other tier of the stacked assembly of loops. The concrete adds substantial ballast and rigidity to the barrier structure.

The invention is not limited to a particular size or shape pipe segment or loop. By way of example and not limitation, a 10 foot diameter and 30 foot long pipe segment 100 may be used with 45° elbows to form a rigid "donut-shaped" octagonal closed loop, approximately 100 feet across (i.e., inner diameter of the loop). A client may specify various pipe diameters and loop diameters to meet the project needs. Thus, each loop or tier in such a stack adds 10 fee to the overall height and about 175 tons of weight to the containment base.

Figure 4:
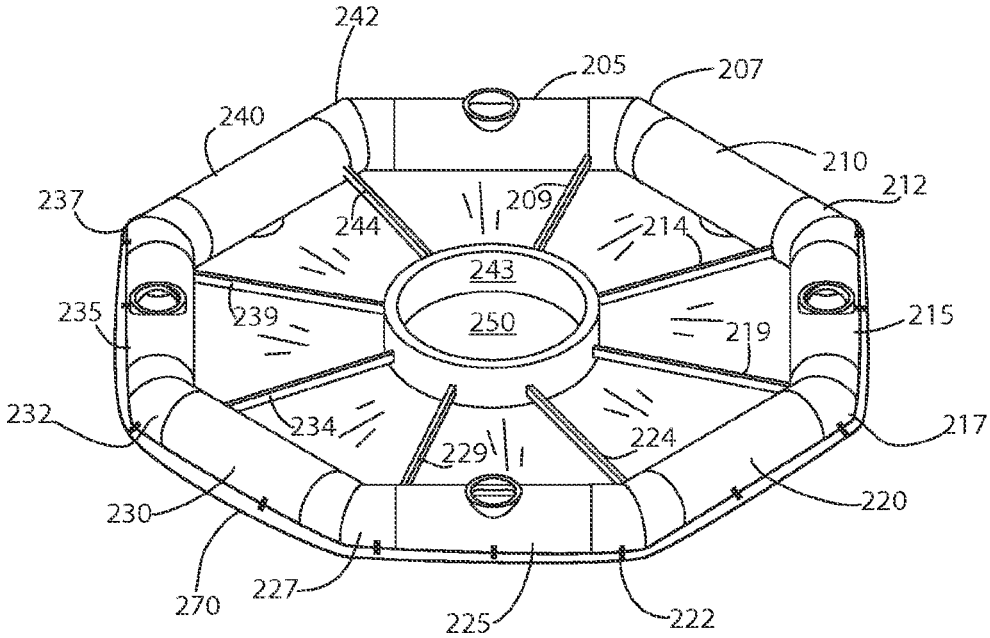
FIG. 4 is a perspective view of an exemplary single level of a concrete containment barrier with a catenary gasket, central collar and radial support braces according to principles of the invention.

As shown in FIG. 4, a collar 243 or stand pipe may be secured in the center of the loop 250 by braces 209, 214, 219, 224, 229, 234, 239, 244, extending radially from the outer periphery of the hub-like collar 243 to the internal periphery of the loop 250. The diameter of the collar 243 is greater than the diameter or width of the leak source. The height of the collar 243 is equal to or less than the outer diameter of the pipe segments, to facilitate stacking.

Figure 5:
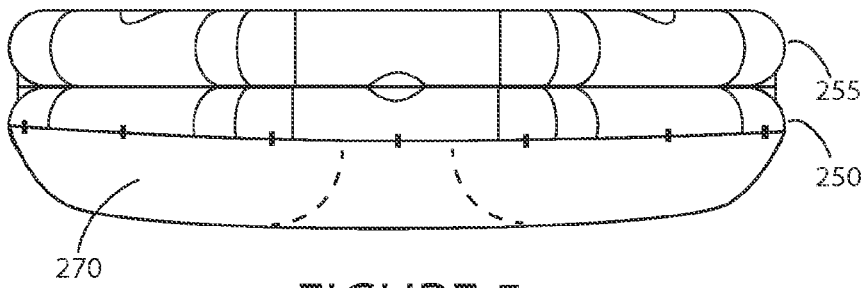
FIG. 5 is a side view of an exemplary two-level concrete containment barrier with a catenary gasket according to principles of the invention.
Figure 6:
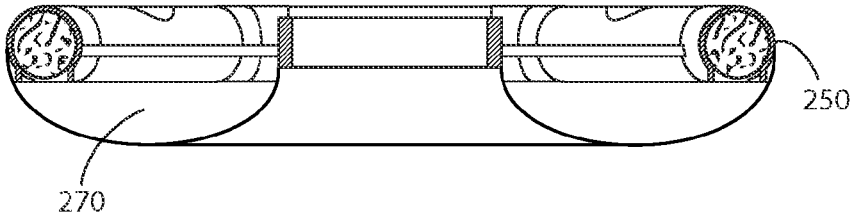
FIG. 6 is a section view of an exemplary one-level concrete containment barrier with a catenary gasket according to principles of the invention.
Figure 7:
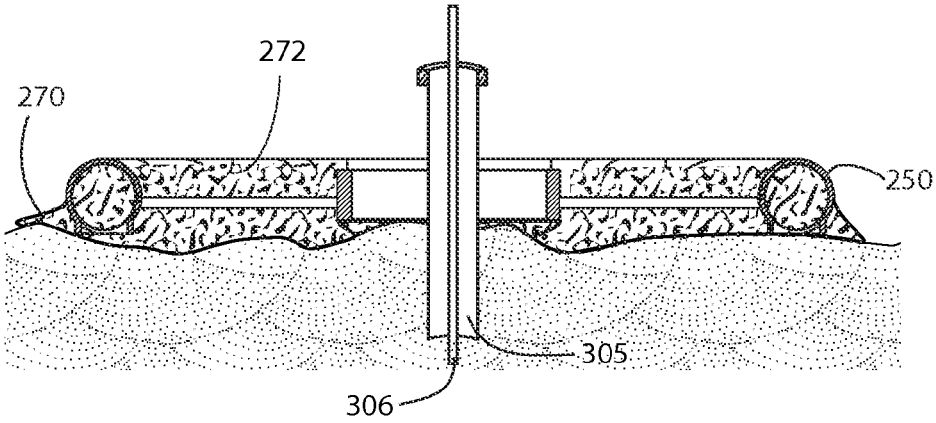
FIG. 7 is a section view of an exemplary one-level concrete containment barrier with a catenary gasket and pumped concrete installed around a well-pipe at a seabed according to principles of the invention.

A catenary gasket 270 is shown in FIGS. 4 and 5, as well as in the section views of FIGS. 6 and 7, among others. The gasket attaches to the bottom of the loop 250 and to the collar 243. The gasket comprises a membrane that loosely covers the annular space between the loop 250 and collar 243. The unattached portion of the gasket is free to drape or hang naturally below the loop 250 and collar 243. The gasket does not cover the collar 243 and, therefore, does not interfere with the stream of leaking fluid when the loop 250 is lowered over the leak site. In a stacked tier, as in FIG. 5, the gasket 270 would only be attached to the bottom tier 250, not to upper tier(s) 255. The loosely draping gasket 270 provides a flexible, durable membrane that conforms to irregularities of the seabed, as shown in FIG. 7. The gasket 270 helps to contain the pumped concrete 272 in the annular space between the collar 243 and loop 250. In so doing, the gasket prevents flow and seepage of concrete away from the annular space. The gasket 270 is preferably comprised of a strong, durable material such as a woven carbon fiber reinforced fabric or a carbon fiber reinforced plastic, which may be somewhat permeable or impermeable.

Figure 18:
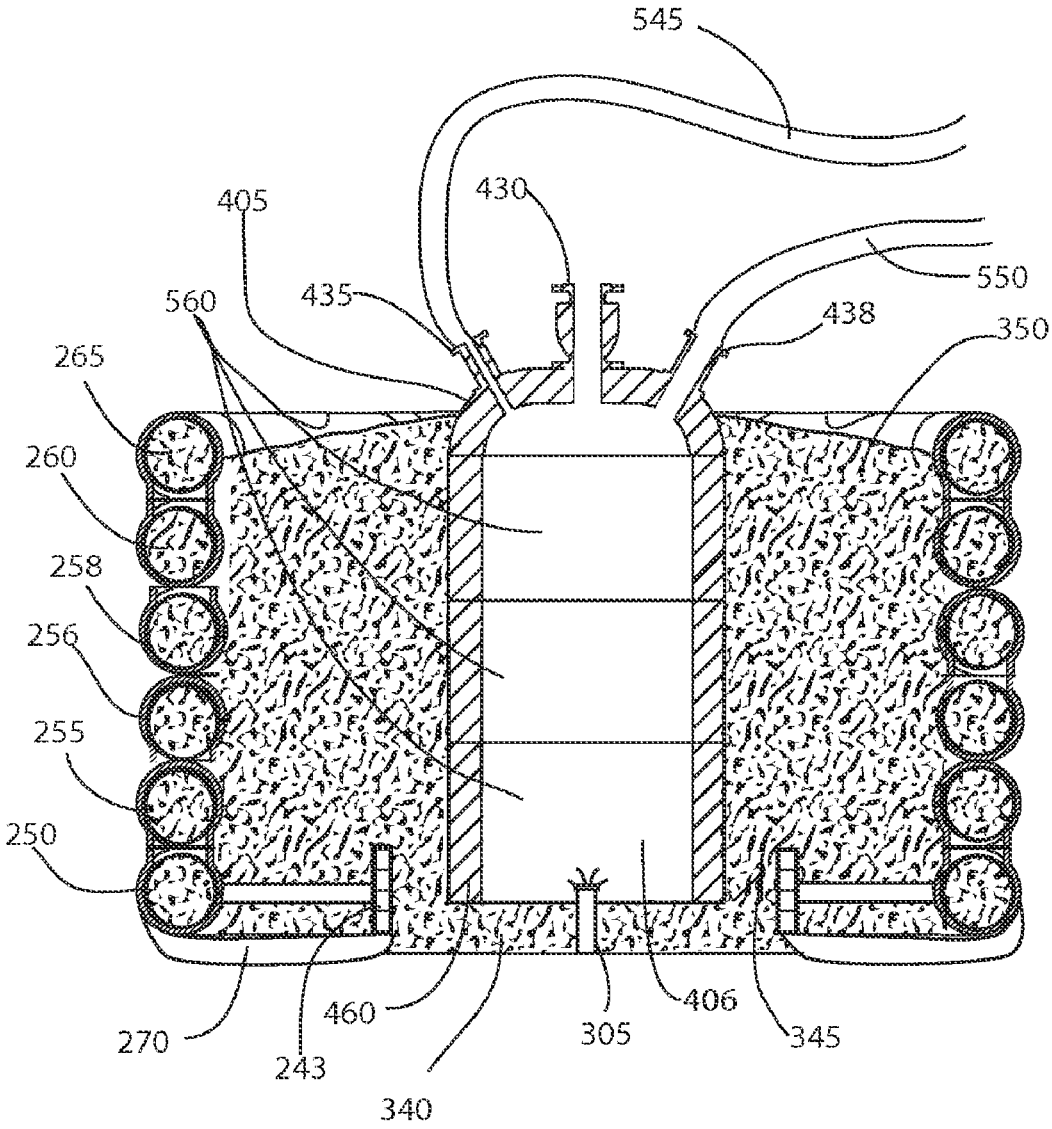
FIG. 18 is a section view of an exemplary open-bottom modular containment vessel, partially embedded in pumped concrete and surrounded by a containment barrier with a catenary gasket, collar and support braces according to principles of the invention.

Any number of loops can be and stacked, one upon another, to a height specified by the client in a manner as to form a central standpipe column, and a surrounding barrier wall. For example, FIG. 5 shows a two-tier stack. FIGS. 10 and 13 through 15 each show a four-tier stack. FIG. 18 shows a stacked arrangement with six tiers. One or more of the stacked loops may have a concentric collar 243. However, the invention is not limited to loops with concentric collars.

Another component of the system is hydraulic concrete, capable of being pumped into the concrete barrier in sufficient amounts to provide ballast to prevent ocean currents and hydrocarbon venting pressures from lifting or otherwise moving it, under the most extreme circumstances. Concrete admixtures can be added to the mixing process to control the rate of hardening of the hydraulic concrete, and enhance its ability to adhere to metal surfaces such as the stainless steel collection container. When filled with concrete, each tier of a 100 foot across containment loop (as describe above) is estimated to contain about 175 tons of concrete. Thus, a 50 foot high containment barrier would weigh about 875 tons, not counting the seawater above it, providing a stable, heavily ballasted base for the collection chamber, not counting the additional apparatus for collecting and controlling the leaking hydrocarbon products that may be otherwise leaking from oil or methane extraction operations, from abandoned extraction operations, or from venting fissures in the seafloor. The hydrocarbon fluids that are to be collected are channeled upwards through a stand pipe that is surrounded with hardened concrete, into the open bottomed collection chamber that was formed when the open-bottomed, bell-shaped, stainless steel containment vessel was lowered into the hydraulic concrete, which has since hardened.

Another major component of the system is a containment vessel, capable of collecting and re-pressurizing venting or leaking hydrocarbons to raise the fluid's temperature to prevent freezing in the cold deep sea environment. Depending on the size, shape and materials used in fabricating the chamber, up to 9000 psi or higher of well head pressure, which will be greatly reduced when spread over the much larger surface area inside of the chambers can be accommodated. A variety of fittings may be incorporated into the top of the vessel.

Figure 8:
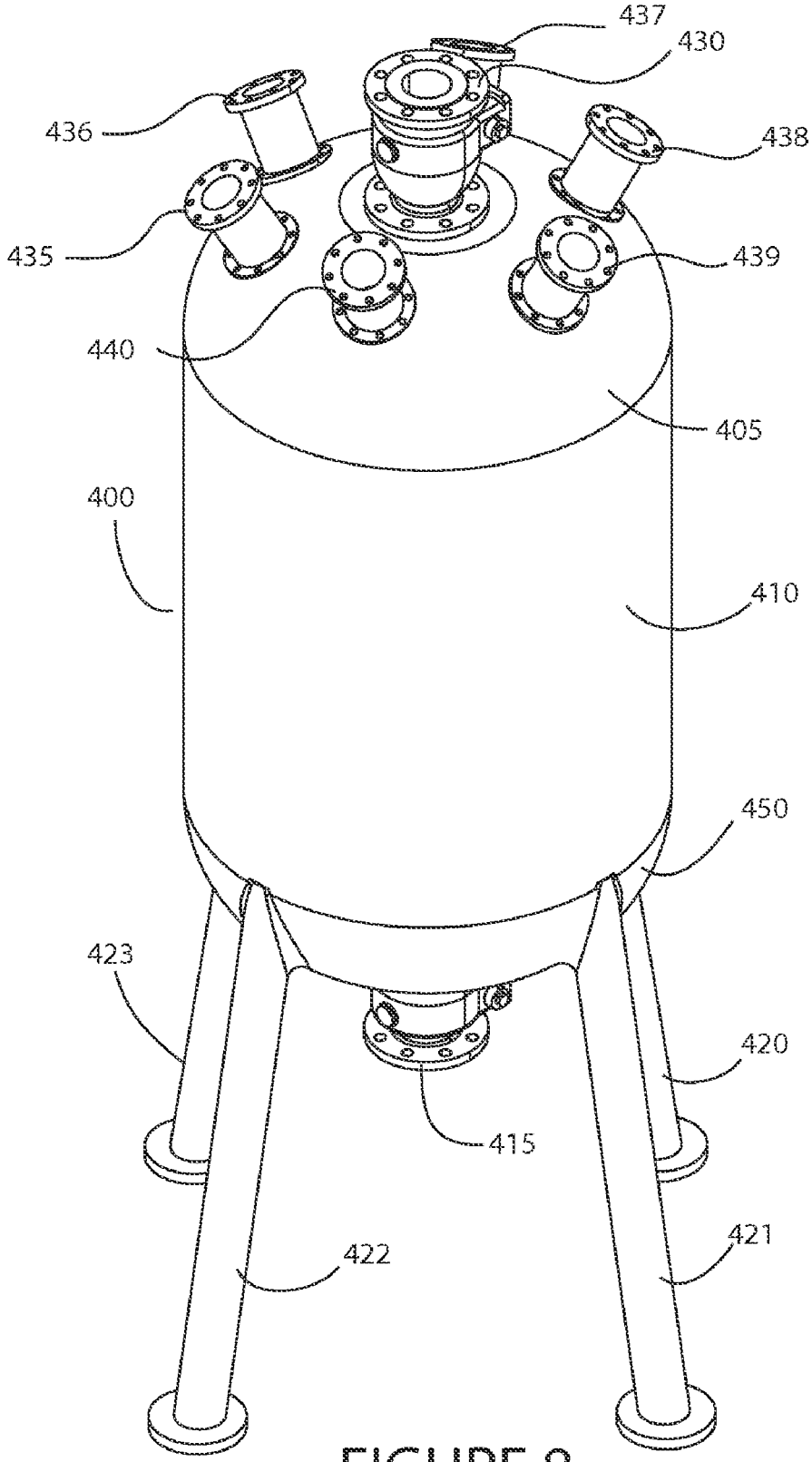
FIG. 8 is a perspective view of an exemplary closed-bottom containment vessel according to principles of the invention.
Figure 9:
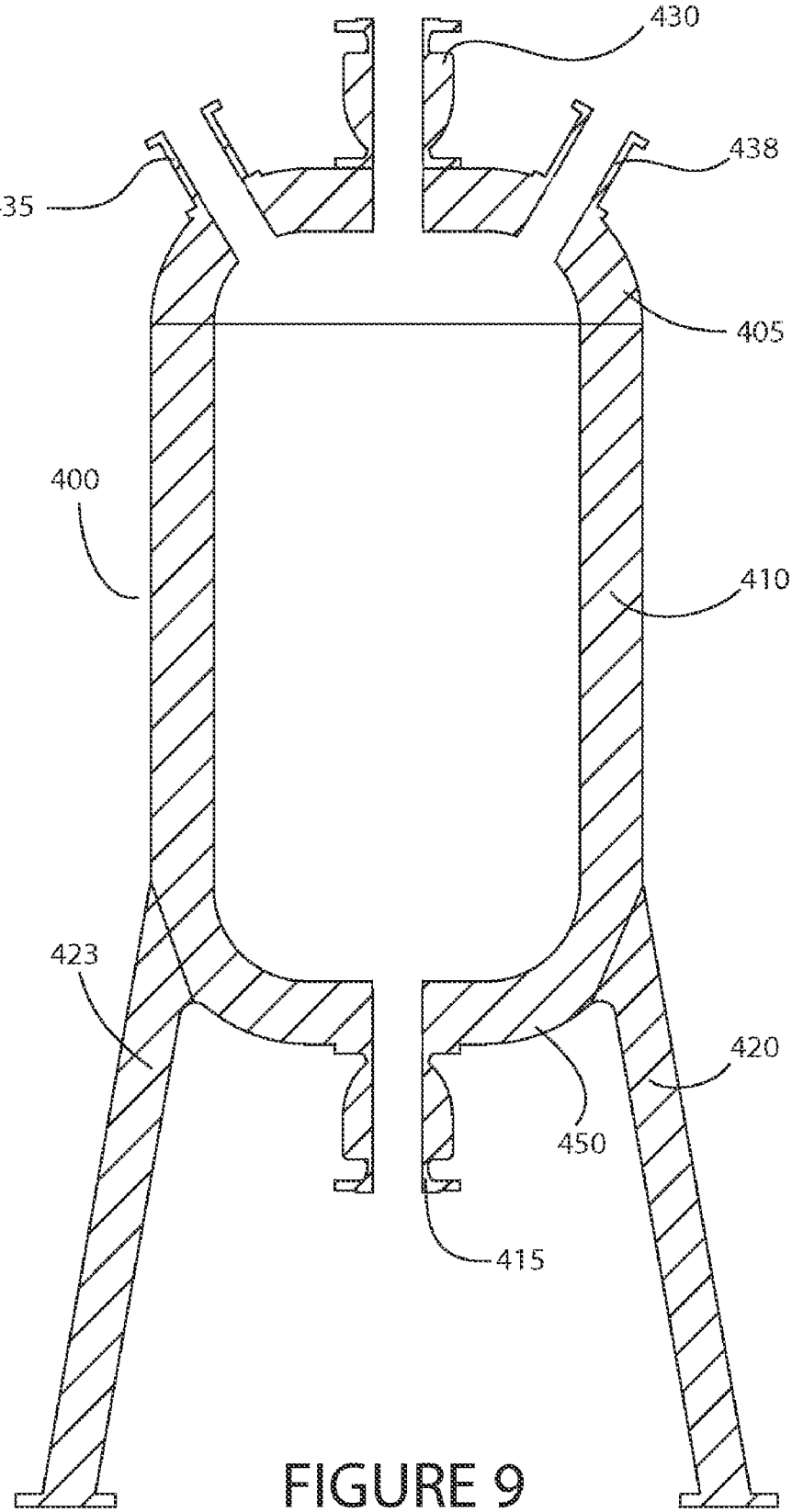
FIG. 9 is a cross-section view of an exemplary closed-bottom containment vessel according to principles of the invention.

One exemplary containment vessel 400 is illustrated in FIGS. 8 and 9. The vessel includes a closed bottom 450 and a closed top 405 and a hollow body 410 between the top 405 and bottom 450. Flanged ports 415 and 430 are provided at the bottom 450 and top 405, respectively. The flange of the bottom port 415 is configured to engage a well pipe or blowout preventer of a well. The flange of the top port 415 is configured to engage well drilling and fluid management equipment such as a blowout preventer, annular and the like. The ports 415 and 430 are sized to allow passage of a well drilling equipment such as a drill pipe. Thus, the ports allow continued use of an adapted well. The port may be sealed or otherwise closed, such as with a valve, when not used.

A plurality of flanged valves and/or ports (referred to herein as valves) 435, 436, 437, 438, 439 and 440 are also provided. The valves allow selective connection of fluid delivery devices such as risers. Risers may be fluidly coupled to manifolds, storage tanks, pumps and others equipment for storage, metering and delivery of contained fluids.

A plurality of legs 420, 421, 422 and 423 support the containment vessel in an elevated position above the well pipe or other component to which the flange of the bottom port attaches. The legs 420, 421, 422 and 423 help to stabilize the vessel 400 and reduce stresses exerted on the well pipe.

Figure 10:
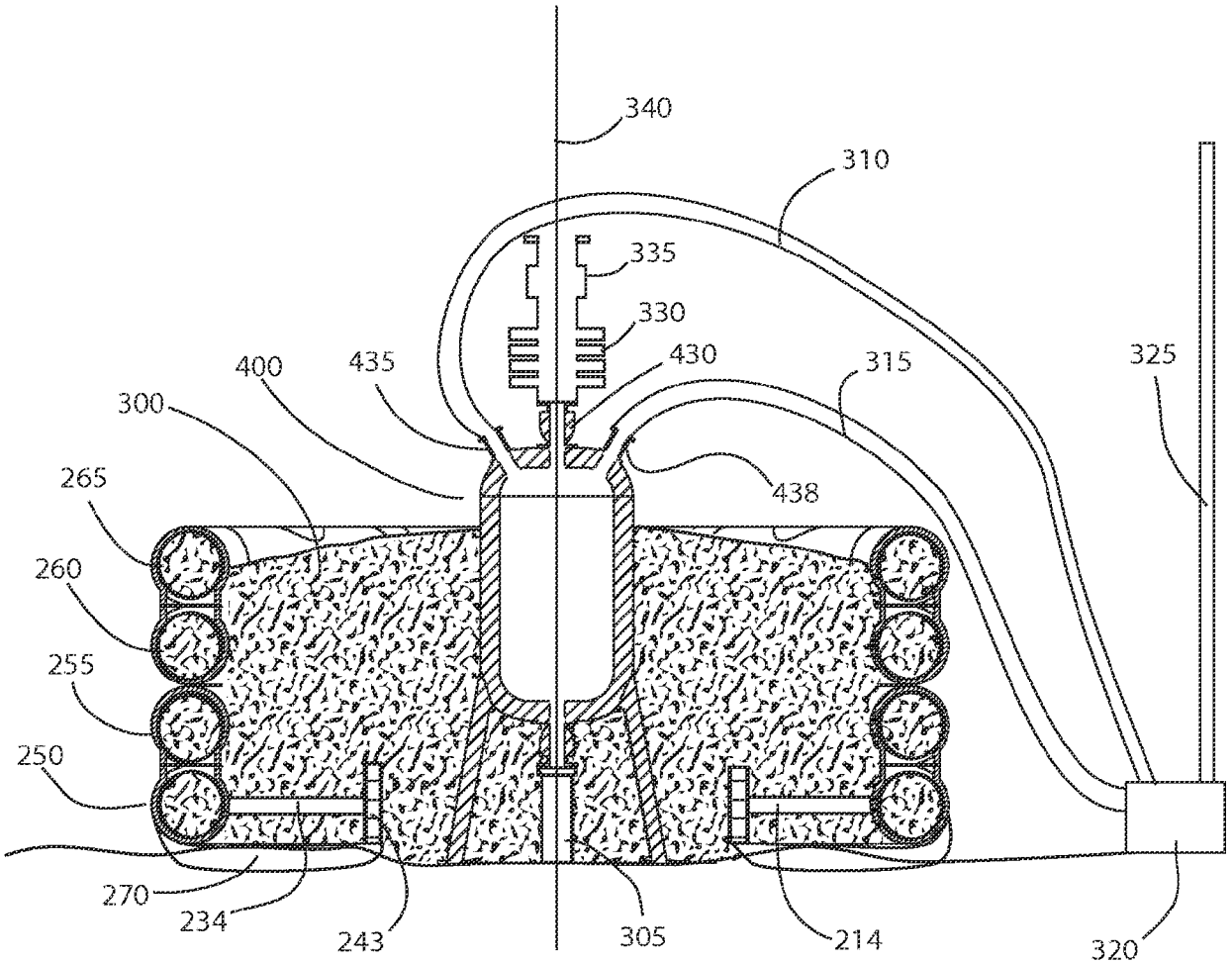
FIG. 10 is a section view of an exemplary closed-bottom containment vessel, partially embedded in pumped concrete surrounded by a containment barrier with a catenary gasket, collar and support braces according to principles of the invention.

Referring now to FIG. 10, the exemplary containment vessel 400 of FIGS. 8 and 9 is shown installed on a well pipe 305. First the four tier stack of cement filled containment barrier loops 250, 255, 260, 265 is lowered over the well pipe 305 (aka well head). The stack is positioned with the well pipe at about the center of the collar 243 secured by braces 214, 234 and others to the bottom loop 250. The gasket 270 conforms to and seals against the seabed. Then, the vessel 400 is lowered and attached to the flange of the well pipe 305. The ports and valves of the vessel 400 are opened to prevent excessive pressure and clogging with ice formations. The relatively large number of valves and ports help substantially relieve the pressure, which facilitates attachment. After the vessel 400 is attached to the well pipe 305, concrete 300 is pumped into the annular space between the collar 243 and stack of loops 250, 255, 260, 265. The pumped concrete fills the annular space, the space around the legs of the vessel and the well pipe 305, and encapsulates most of the containment vessel 400. The top of the containment vessel is left un-encapsulated. A blowout preventer 330 and annular 335 are shown attached to the top port 430. A pair of risers extend from ports 435, 438 to a fluid delivery device 320 which may be a manifold and pump and/or meter. The fluid delivery device 320 pumps the fluid to a surface ship or platform via a riser 325.

The composition of the vessel is not particularly important, so long as it withstands the environment and conditions in which it is used. In one exemplary embodiment, a relatively small container, that will accommodate the highest pressures, is formed of heavy rolled stainless steel formed into a pressure resistant tube with the top end and bottom ends closed, except for up to seven connection fittings at the top end, and a centrally located fitting capable of being attached to a well head (or other client specified device) at the bottom end. The top center fitting enables petroleum extraction components to be attached, such as "stack connectors," "blowout preventer (BOP) stacks," capping stacks," and "annular preventers." The six top peripheral fittings accommodate such attachments as valve control packages, "pressure and temperature monitoring choke lines," and "petroleum risers" for transporting extracted materials to surface vessels.

Figure 11:
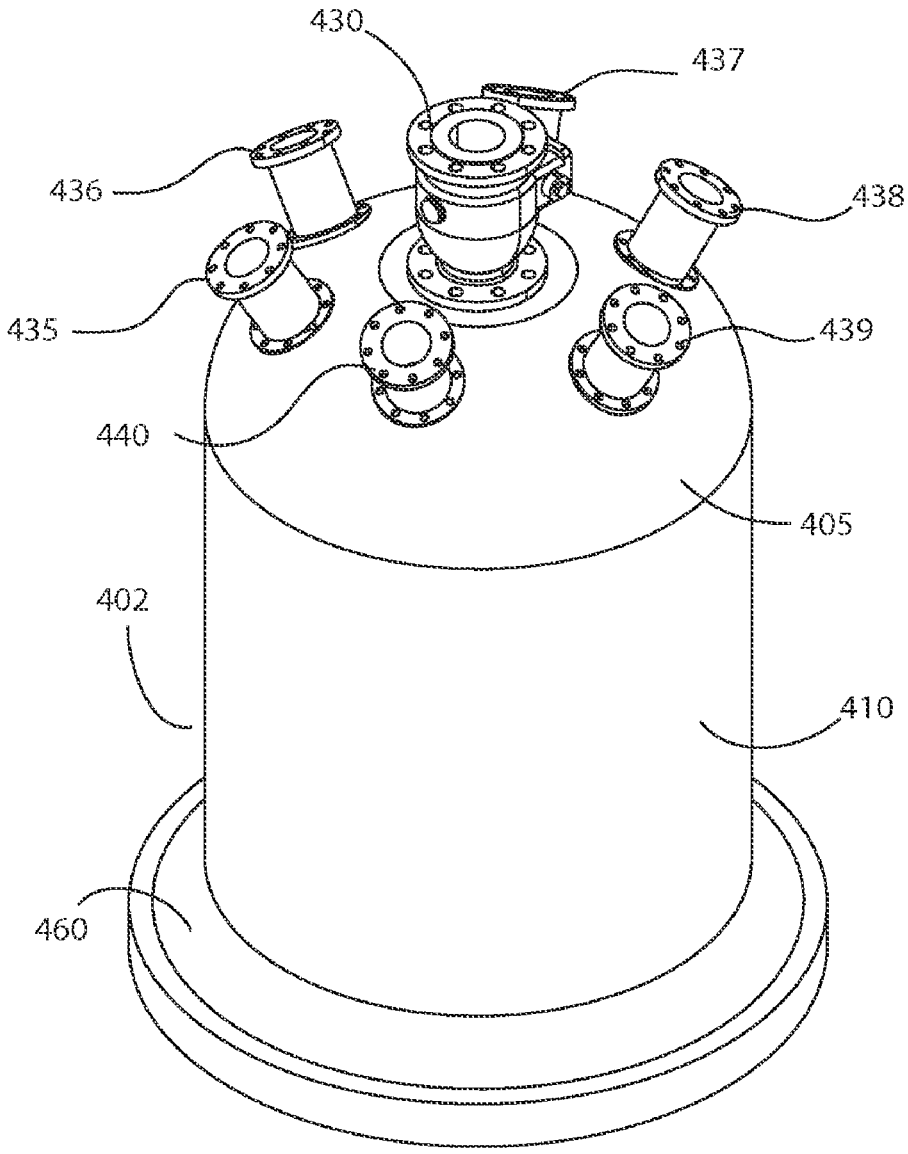
FIG. 11 is a perspective view of an exemplary open-bottom containment vessel according to principles of the invention.
Figure 12:
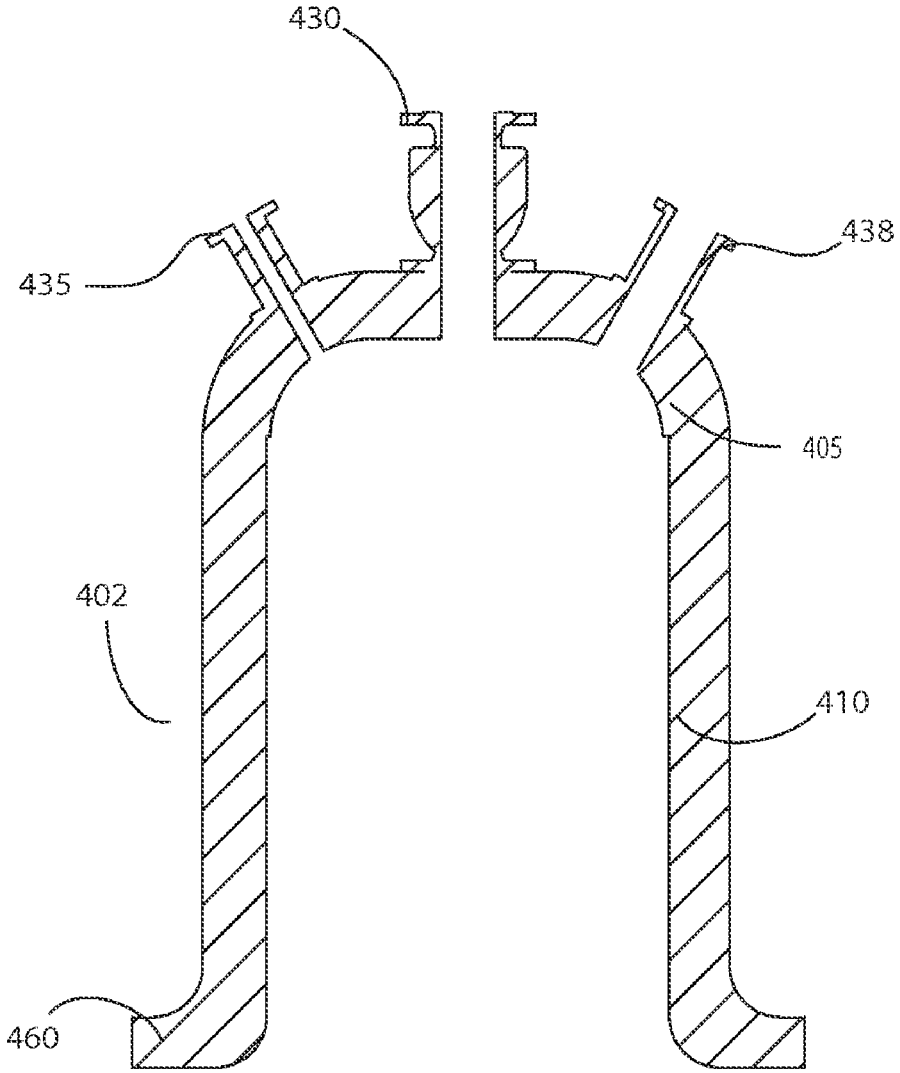
FIG. 12 is a cross-section view of an exemplary open-bottom containment vessel according to principles of the invention.
Figure 13:
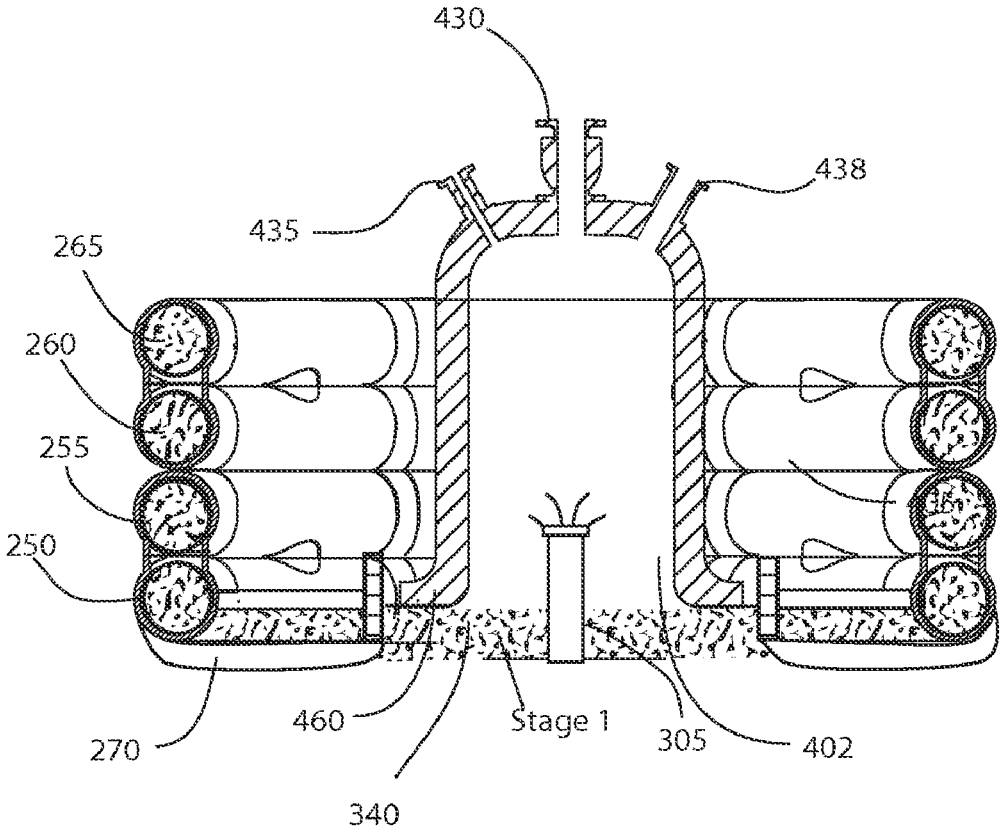
FIG. 13 is a section view of an exemplary open-bottom containment vessel, placed on a pumped concrete base surrounded by a containment barrier with a catenary gasket, collar and support braces according to principles of the invention.
Figure 14:
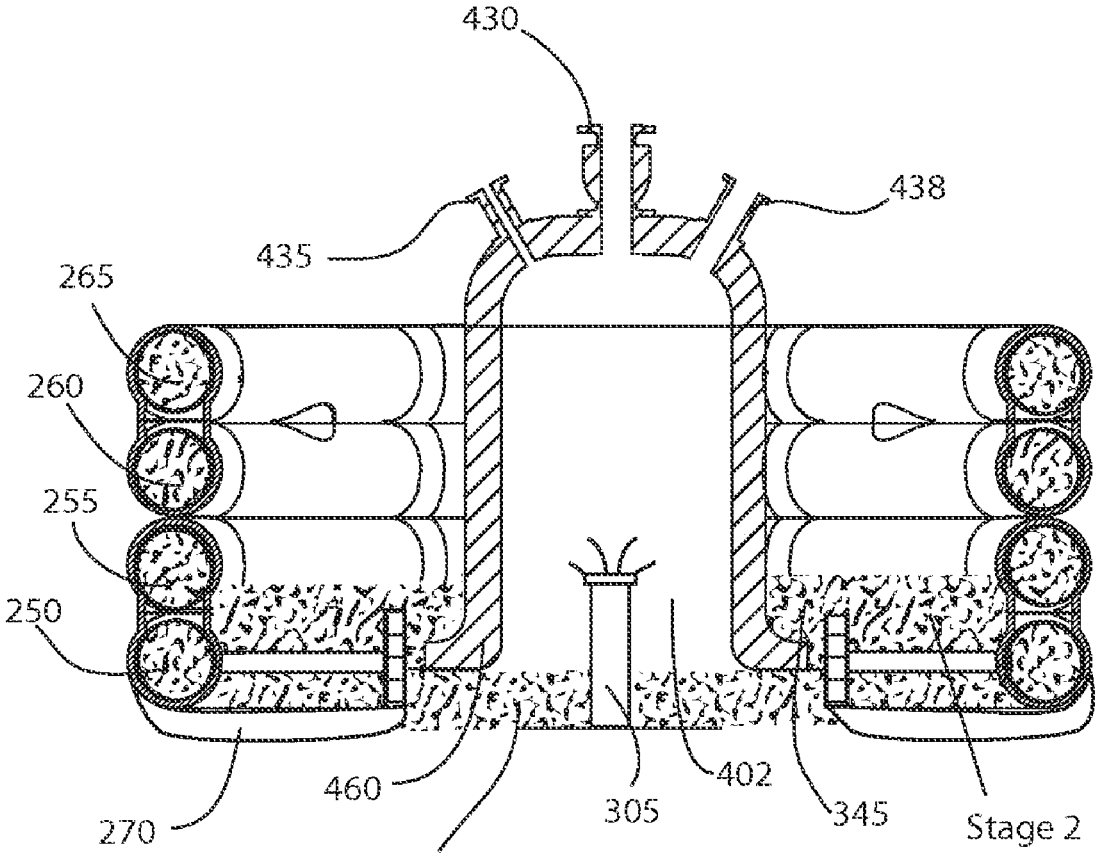
FIG. 14 is a section view of an exemplary open-bottom containment vessel, anchored in pumped concrete on a pumped concrete base surrounded by a containment barrier with a catenary gasket, collar and support braces according to principles of the invention.
Figure 15:
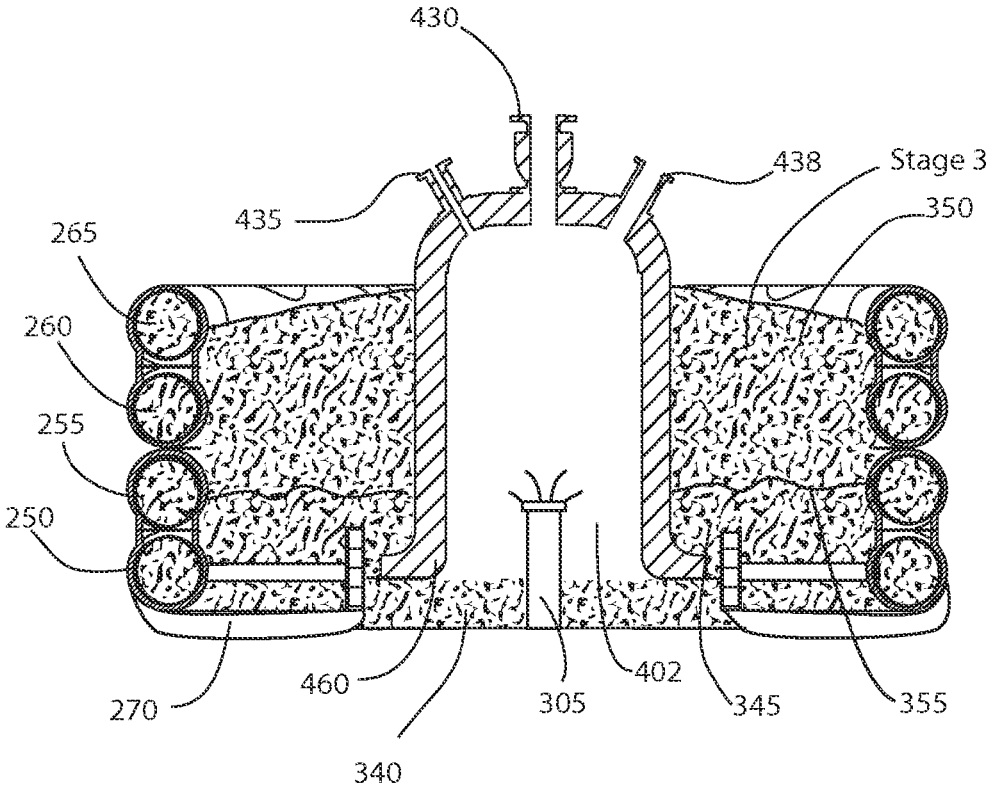
FIG. 15 is a section view of an exemplary open-bottom containment vessel, partially embedded in pumped concrete and anchored in pumped concrete on a pumped concrete base surrounded by a containment barrier with a catenary gasket, collar and support braces according to principles of the invention.

Another containment vessel 402 is open ended, as illustrated in FIGS. 11 and 12 as well as FIGS. 13 through 15. This exemplary vessel 402 is similar in purpose and shape to the closed-end vessel 400 described above, except the bottom is open to enable the open end to be slipped over the top of the stand pipe 305 previously described. A flanged port 430 is provided at the top 405. The flange of the top port 415 is configured to engage well drilling and fluid management equipment such as a blowout preventer, annular and the like. The port 430 is sized to allow passage of a well drilling equipment such as a drill pipe. Thus, the port allows continued use of an adapted well. The port may be sealed or otherwise closed, such as with a valve, when not used.

A plurality of flanged valves and/or ports (referred to herein as valves) 435, 436, 437, 438, 439 and 440 are also provided at the top 405. The valves allow selective connection of fluid delivery devices such as risers. Risers may be fluidly coupled to manifolds, storage tanks, pumps and others equipment for storage, metering and delivery of contained fluids. The top center port 430 and the six peripheral fittings 435, 436, 437, 438, 439 and 440 accommodate such attachments as "valve control packages," "pressure and temperature monitoring choke lines," and "petroleum risers" for transporting extracted materials to surface vessels. The bottom includes a rolled flange 460 to improve the retention of the vessel 402 in concrete.

Installation of the open-end vessel is accomplished in several steps. First the four tier stack of cement filled containment barrier loops 250, 255, 260, 265 is lowered over the well pipe 305 (aka well head). The stack is positioned with the well pipe at about the center of the collar 243 secured by braces 214, 234 and others to the bottom loop 250. The gasket 270 conforms to and seals against the seabed. In a first stage as shown in FIG. 13, a concrete base 340 is pumped and allowed to harden. The height of the base is less than the height of the stand pipe 305, which is less than the height of the first tier 250. The base provides a stable support for the vessel 402 and prevents additional concrete from flowing beneath the vessel and into the cavity of the vessel 402. Then, the vessel 400 is lowered over the well pipe 305. The ports and valves of the vessel 402 are opened to prevent excessive pressure and clogging with ice formations. The relatively large number of valves and ports help substantially relieve the pressure, which facilitates attachment. After the vessel 400 is lowered over the well pipe 305, concrete 300 is pumped into the annular space between the collar 243 and stack of loops 250, 255, 260, 265 to anchor the vessel in place, as in stage 2 shown in FIG. 14. Here, the flange 460 of the vessel 402 is embedded in concrete 345. Next, additional concrete 350 is pumped into the space between the stack and the vessel 402 to encapsulate most of the containment vessel 402, as in stage 3 shown in FIG. 15. A bonding agent 355 may be included in the concrete mix to enhance bonding between the various layers of concrete. The top of the containment vessel 402 is left un-encapsulated. After encapsulation, the ports and valves of the vessel 402 may safely be closed. A blowout preventer and annular may be attached to the top port 430. Risers may extend from ports 435, 438 to a fluid delivery device which may be a manifold and pump and/or meter. The fluid delivery device pumps the fluid to a surface ship or platform via a riser.

Another type of vessel 406 as shown in FIG. 18 is designed to accommodate lower pressures, such that may be encountered from natural fissures, or leaking wells. It consists of a taller containment vessel assembled from a series of concrete containment loops 250, 255, 256, 258, 260, 265, stacked as previously up to a desired height (e.g., 100 feet in height) to reach much greater in height and much greater interior volume. The vessel is comprised of the stacked sections 560 and a top 405. Each stacked section can be custom made to a desired diameter and stacked to form a very tall column-shaped pressure container. In one embodiment, the stacked sections are separate from the loops 250, 255, 256, 258, 260, 265. In another embodiment, the stacked sections are comprised of stacked collars 243 of the stacked loops 250, 255, 256, 258, 260, 265. For low pressure applications, the stacked sections can be assembled from less expensive materials, and cost less per cubic yard of volume than the previously described collection chambers. The sections are encapsulated in concrete 350 as shown in FIG. 18. The top of the containment vessel 406 is left un-encapsulated. After encapsulation, the ports and valves of the vessel 406 may safely be closed. A blowout preventer and annular may be attached to the top port 430. Risers may extend from ports 435, 438 to a fluid delivery device which may be a manifold and pump and/or meter. The fluid delivery device pumps the fluid to a surface ship or platform via a riser.

The process by which the system is designed, configured, assembled and deployed can be described as a series of phases. A first phase entails preparing the drill site or venting capture site. Generally, modifications to the seafloor surface around the drill site will not need to be significantly modified for the apparatus to be situated around a potential drill site, or potentially harvestable venting fissure. A topographical depiction of the sea bottom in an area with a radius of 60 feet would be provided to the barrier fabricator. If the process is to be used to secure an abandoned well site, derricks, pipes and others abandoned material that may interfere with the concrete base barrier would need to be removed or mapped.

The site may be surveyed to obtain a three-dimensional depiction of the seafloor in an area around the abandoned well to a radius of 10 to 50 feet, depending on the proposed capping solution, would be depicted and provided to the barrier supplier. From these depictions and measurements, the height of the containment barrier can be increased by adding additional loops and standpipes to the barrier structure. The entire containment barrier can be designed per specifications, the components delivered to a holding area near the intended application site, and then welded together on a crane/barge for delivery to the site.

Figure 16:
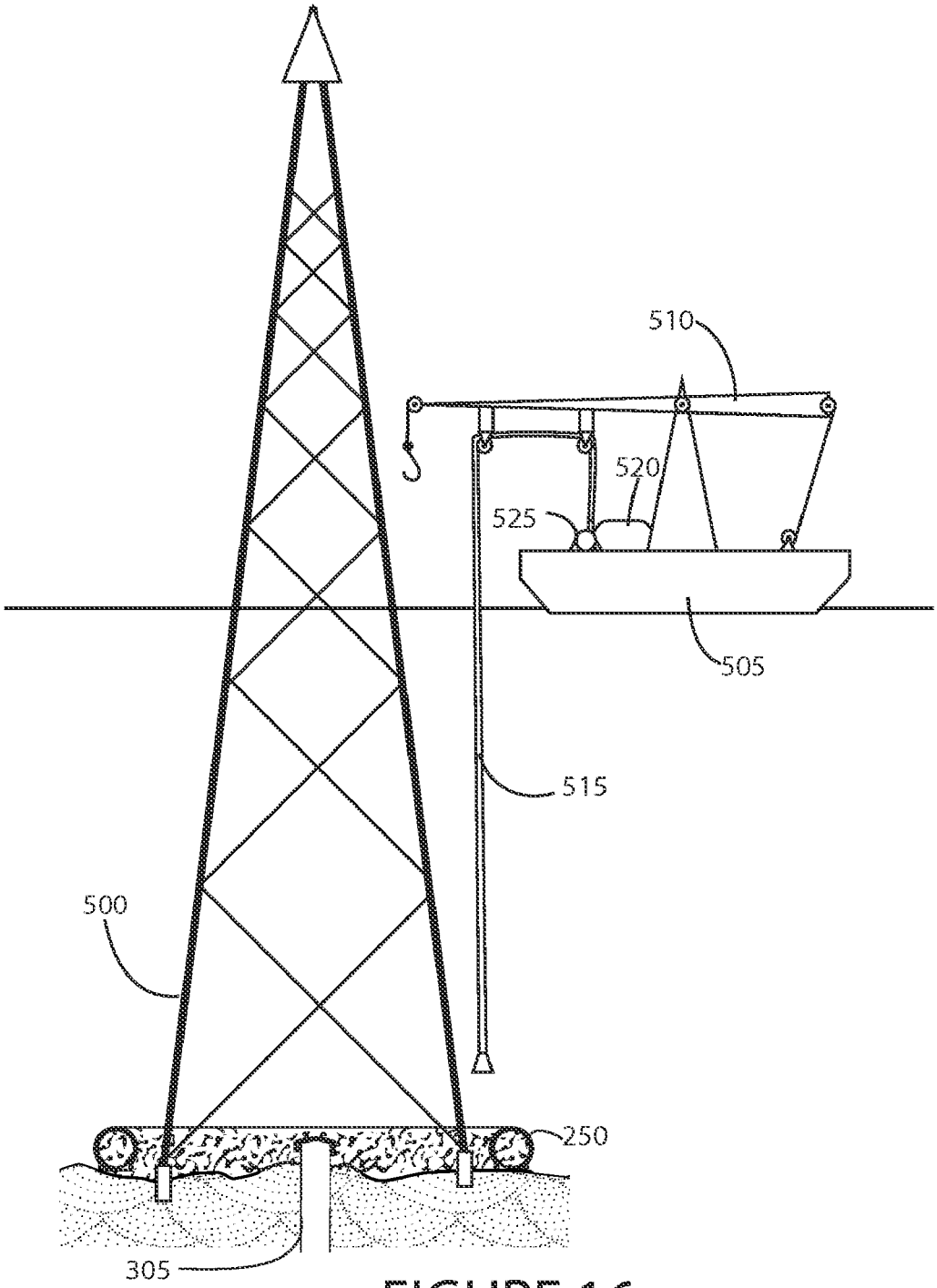
FIG. 16 is a schematic illustrating a concrete delivery vessel according to principles of the invention.
Figure 17:
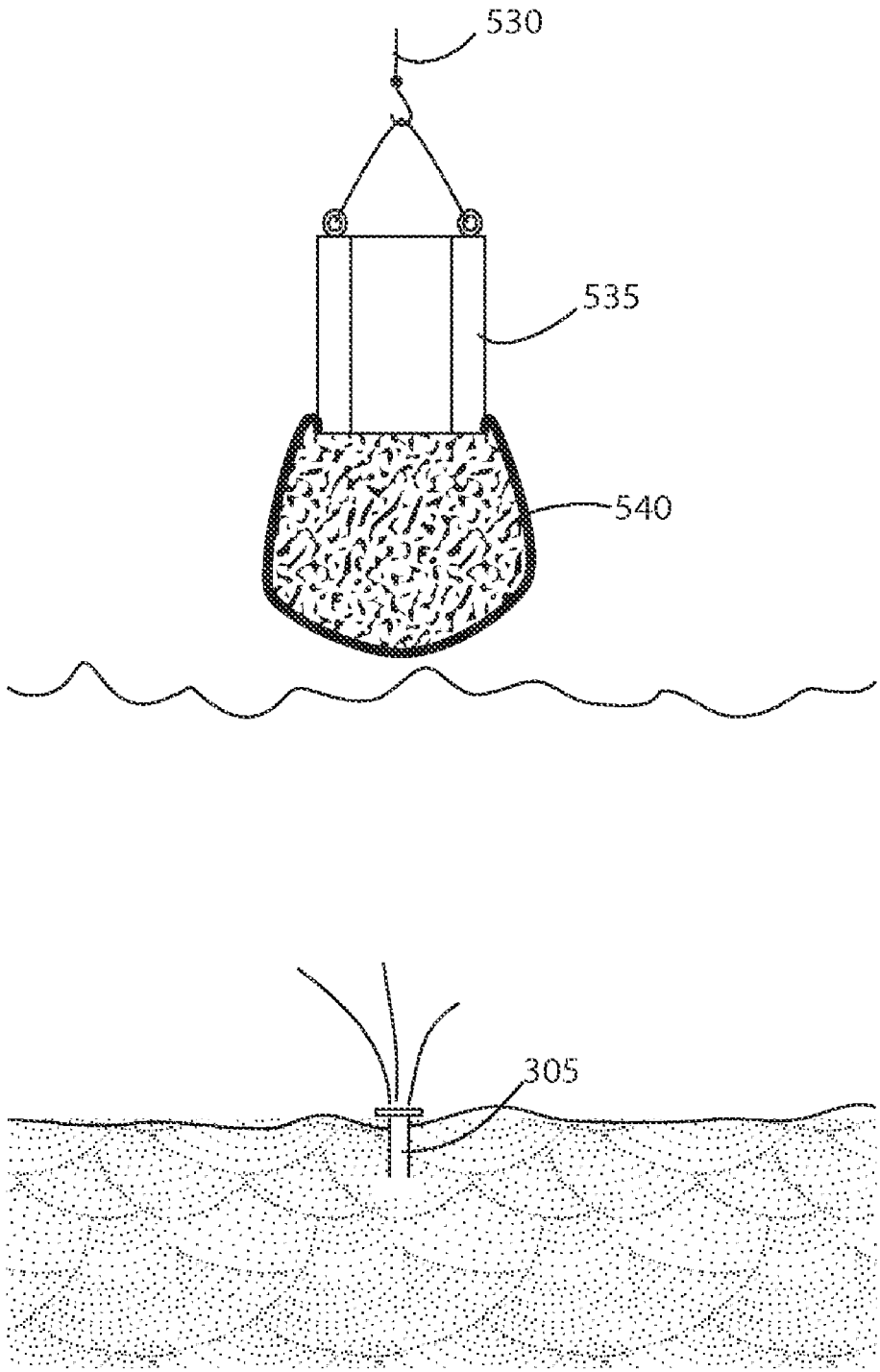
FIG. 17 is a schematic illustrating a collar with a catenary gasket containing concrete for encapsulating a leak source according to principles of the invention.

If a test well or a new well is to be drilled, the concrete base barrier (base barrier) is lowered by a crane on the barge and positioned with the collar directly over the intended well site. An hydraulic concrete mixture is prepared and transported to the drill site via a barge or other ship 505 as shown in FIG. 16 with continuous agitation 520, cranes 510, and a pump (e.g., peristaltic pump) 525.

A concrete mix is pumped into Tee openings in the top layer of the concrete base containment barrier, (the barrier). The concrete mix is pumped into the upward facing "T" openings in the of the top barrier loop until the entire containment barrier is filled. Then the concrete is allowed to harden, creating a rigid barrier structure for the concrete ballast admixture to be pumped into the barrier if needed.

This is a good time to order or prepare for installation a containment vessel, and a hydraulic concrete (ballast admixture), a series of heavy duty, controllable well cut-off valves (capping stack) and a drill pipe collar bypass leak prevention device (annular preventer), and any additional devices. The devices can then be installed before any kick, leak or other event occurs that would disrupt the drilling. If a blowout preventer stack is not installed, it is advisable to have hold-down anchors and drawdown cables installed in the interior of the base barrier prior to its delivery.

Although less desirable, it is also possible to install the above described blowout preventer stack after a methane kick occurs. The drilling operation must be stopped, the drill pipe withdrawn, and the ballast admixture pumped into the annular space inside the base barrier to the top of level of the top of the stand. Immediately after the ballast admixture is pumped in, an "open ended" containment vessel is installed over the top of the collar, lowered halfway into the ballast mixture, and allowed to harden. All this can be done while the blowout is in progress.

If it is a major blowout, all the valves in the containment vessel and capping stack are opened to allow the apparatus to settle into the ballast mixture, and drawn into position with the aid of previously placed anchors and drawdown cables, and remote operated submersible vehicles After the ballast admixture hardens, the valves in the containment vessel can be carefully closed while monitoring the internal pressure and temperature until it is known that the oil methane mixture will not freeze, and wait for the blowout to subside. Once the blowout pressure drops sufficiently, the drill pipe can be re-inserted into the top of the drill stack, and drilling restarted.

If the blowout is so severe that the blowout stack, (including the conventional BOP fails, the drill string can be removed and yet another containment vessel and capping stack (with initially open valves) can be installed. This can be repeated until the blowout is controlled. Each successive containment vessel with the risers attached would serve to channel the blowout materials to surface collector vessels, and avoid methane hydrates.

If the purpose of the operation is to plug one or more abandoned and leaking wells, the concrete barrier loop may be much smaller, usually have a smaller pipe size, perhaps, for example a loop greater than 10 feet in diameter, and a pipe diameter of three feet, and will not include a collar.

Methane, venting from naturally from open fissures in the seafloor can also be harvested, both for the commercial value, and for environmental benefit. Generally, such venting is in substantial volumes, and at lower velocity rates. If collection of naturally venting methane from the seafloor is undertaken, the venting area would be carefully surveyed and the bottom terrain depicted in 3 dimensions in order to assure a complete encompassing of the venting fissures, and to accommodate the likely irregular bottom topography. With careful seafloor topographic mapping, a base barrier can be configured around one or more fissures, and corresponding standpipes.

To keep the harvesting costs low, the containment vessels consist of only of a client determined number of layers of concrete containment barriers arranged for appropriate area coverage, within which the appropriate number of tall standpipes, each capped with the same type of containment vessel "top" as were the tops of the previously described containment vessels.

Specially designed concrete containment barrier would be fabricated at the nearest onshore facility and barged to site and lowered in place to encompass all of the fissures. The client would specify the number of containment layers (and corresponding height of the containment "silos") to use, based on exploratory data. The chances are that the venting pressure would be great in volume but relatively low in pressure. If multiple fissures were encountered, multiple standpipes and collection chambers would be needed. It may be possible to use the tall, lower pressure/high volume containers in this type of harvesting operation.

Hydraulic concrete could be pumped into the annular spaces, which are reduced in overall diameter, to reduce the amount of buttressing/ballast admixture. Venting gasses accumulating in the compression chambers will cause the internal pressures to rise to stasis, where flow would stop, and there would be little risk of blowouts or methane hydrates forming. Periodically, collection vessels would make rounds to collect the contents via the attached peripheral valves and risers. As the venting subsided, the pumps in the collection manifolds could continue to evacuate any remaining methane. After there was none remaining, the valves and risers could be salvaged, and the silo's converted to undersea storage tanks of perhaps military, commercial or oceanographic value.

The system could also be used to stop leaks in abandoned oil wells. Many can be plugged with heavy mud or pumped into the well bore, and a mixture of mud and sealing cement pumped into the spaces around the well bore. Plugging wells in this manner is slow, laborious and involves many forms of support, such as diving gear, boats, pumps, barges, and the like. Then, because the annular spaces within and around the wells are so narrow and subject to erosion, many begin to fail in a few years. So, the often futile effort is not undertaken when wells are abandoned because they are no longer viable producers, This system contains products and processes that can make it commercially feasible to plug the wells that are leaking or likely to leak. To do this, a specially designed well plug, made from a single 10×10 concrete standpipe can also be use for this purpose. A segment of standpipe is fitted on the bottom with the flexible, baggy, impermeable membrane, except it encloses only the bottom. The bottom half is filled with hydraulic concrete, contained by the membrane, and it is carried by helicopter while still wet to a leaking well, and lowered over it. Its weight and the flexibility membrane will settle around the wellhead, or open well will cause it to conform to the bottom micro-topography and seal it against the surrounding bottom. Its main cost is that of ordinary concrete and the membrane, and the fuel to deliver it to the well site. It requires no "in-the-water human effort, or other supporting equipment to seal dozens of wells in a single day. It is sized to permanently contain the small amounts of oil and methane seepage that would be expected over the years.

If a drilling derrick 500 is still in place, as shown in FIG. 16, and it cannot be easily removed, or if it is located in deep water, several of these can be spotted, and arrangements made with a barge company that handles barges fitted with agitation, pumps and crane capabilities can transport several small concrete base barriers 250 to the well sites, lower the barriers around the wells, and fill them with a heavy mud/hydraulic concrete mixture. The derricks would simply be incorporated into the concrete base barrier and no in-the-water human effort or other support equipment would be needed. Concrete would be pumped through a supply line 515.

During the placement of the containment vessels, in their concrete bases, the top fitting and bottom fittings, and the six surrounding risers valves would all be open to facilitate lowering the chamber. At this point, all presenters, stacks and risers valves would remain open to facilitate attaching all the other devices, with no pressure buildup. After the capping stack was in place, and the peripheral valves can be closed one at a time to avoid significant pressure build up, and the risers attached to the valves and to the manifold, followed by opening the valves again to avoid pressure buildup. When all the valves are connected to the manifold and open, the valves can be closed again one by one, and the pressure buildup monitored to enable the optimum combination of temperature, pressure and flow through to the manifold and up to the surface collection vessel. When that was completed, the entire well pressure would be diverted into the riser manifold at a temperature to avoid methane hydrate crystal formation. At this time also, the an annular preventer (a device from another source capable of closing around a drill pipe to prevent blow-bys) can be attached to the top of the capping stack, already attached to the top of the pressure chamber. When the annular presenter(s) are closed around the drilling apparatus, blow-bys can be prevented when drilling is restarted.

The process of collecting methane from natural fissures is similar to the that of the drilling process, but because of varying sizes and shapes of the fissures, a larger, and often irregular shaped containment barrier is called for. The venting pressures are likely to be steady, and dissipate more quickly, so a quick determination of the size of the concrete base, its resulting ballast weight, and the size and location of the containment vessel must be quickly made by the client. Blowout and annular presenters are likely to be optional, unless it is determined that follow-up drilling is viable after the natural venting has subsided. The shape of the concrete containment barrier must conform to that of the venting fissure, and its height and amount of ballast to the clients specifications, which will assure that the concrete will not be lifted by the newly contained gas pressure.

It is doubtful that sufficiently viable amounts of hydrocarbons can be collected from individual abandoned wells, but many such wells are still connected to seafloor connecting grids, and if leaking segments of the grid can be plugged, and leaks re-routed to non-leaking segments to enable several formerly leaking wells to be aggregated, collection of these leaks may become viable as supplies are better supplies are exhausted.

The invention may be used to contain an unexpected high pressure blowout. Since the materials used in the first and second phases of this process are relatively inexpensive, it is economically feasible and perhaps prudent to install concrete base barriers as a precaution at new and potential well sites with high risk potential. The low material cost can encourage developing heavier than anticipated concrete beds to gain a greater safety margin. Since the size of the bed and the size of the containment vessel often can be more viably up-scaled, lower than expected blowouts risks can be achieved.

Secondly, the system can be deployed in a matter of weeks, to arrest, control and harvest a blowout, even if no previous prevention phases had launched. Of the two containment system designs, one is designed to be installed over an already blowing well, and can contain it without significant risk of creating a sub-seafloor rupture of the reservoir. A generously-scaled concrete base barrier can be placed around the blowout, which can continue through the standpipe in the base without impedance. When capped, the heavier base can lessen the likelihood of causing a subterranean rupture, and assist in diverting the pressure to the collection risers, as well as lessen the rupture possibility.

The third phase, which can including installing a capping stack and an annular preventer, both of which can be left open enabling the eruption to blow through the entire stack. The valves of the capping stack can then be closed, diverting all of the pressure through the six valves and risers, enabling the harvestable materials to be collected for processing. A conventional blowout preventer, available from another source can be installed on top of the capping stack, as a precaution against future blowouts in the drilling process. The six remotely controllable peripheral valves can be manipulated to keep the internal pressure and temperature high enough to prevent hydrate crystals from blocking the risers. The annular preventer can be closed around a drill pipe, and the drilling resumed after the blowout pressure subsides, until the reservoir is exhausted.

After the oil and methane reservoirs are depleted, the well is to be permanently closed, the components of the process such as blowout and annular presenters, valves and risers can be easily removed, and the remaining well head can be sealed in a manner convenient to the extraction company. The concrete base and vessel can remain in place without causing any environmental degradation, except if it is located where it may be an obstacle to navigation. In that case, navigation hazard buoys can be attached to well head cover plates bolted to the top opening of the vessel. If navigation is not an issue, the vessel may be left open to provide habitat for smaller sea creatures.

If the well is to be closed for an undetermined time, all of the blowout and annular presenters, valves and risers can be removed, and the fitting and interior surfaces coated with a corrosion preventative and all mating surfaces then covered with bolt-on caps. All exterior surfaces can be spray coated with a corrosion resistant material before the components are initially deployed, and coated again at two year intervals. If the well is to be closed and possibly reopened in less than two years, the capping and annular preventers need not be removed, but if they are, and the facing surfaces can be coated with a corrosion preventative. In any event, the peripheral valves and the risers can remain in place and coated with client selected preservative.

In another implementation, a leaking or unused well head may be encapsulated by covering the entire well head with a collar 535 and a bag-like gasket 540 containing hydraulic cement. The collar and gasket assembly may be lowered using a crane 530 or any other suitably equipped vehicle or equipment. The gasket will settle over the well head and conform to the sea bed. The concrete will at least partially fill the collar 535, cure and seal the well head 305/

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A system for controlling leakage of hydrocarbon fluids from a leak source at a seabed, said system comprising a closed loop containment barrier positioned around the leak source and defining a volume into which hydraulic concrete may be pumped, a containment vessel positioned over the leak source in the volume into which hydraulic concrete may be pumped, said containment vessel having an interior compartment into which hydrocarbon fluids may be captured and an exterior, and pumped hydraulic concrete filling at least a portion of said volume and encapsulating the exterior of at least a portion of the containment vessel; and a catenary gasket attached to the closed loop containment barrier, said catenary gasket comprising a flexible material that conforms to the shape of the seabed and defines a surface upon which the hydraulic concrete may be pumped and cured.

2. A system for controlling leakage of hydrocarbon fluids from a leak source at a seabed as in claim 1, said closed loop containment barrier being filled with concrete.

3. system for controlling leakage of hydrocarbon fluids from a leak source at a seabed as in claim 1, said system further comprising a collar defining a central channel, said collar being concentric with the closed loop containment barrier and attached to the closed loop containment barrier by a plurality of elongated braces, and said containment vessel fitting within the collar.

4. A system for controlling leakage of hydrocarbon fluids from a leak source at a seabed as in claim 3, said system further comprising a catenary gasket attached to the closed loop containment barrier and the collar, said catenary gasket comprising a flexible material that conforms to the shape of the seabed and defines a surface upon which the hydraulic concrete may be pumped and cured, said catenary gasket not covering the channel of the collar.

5. system for controlling leakage of hydrocarbon fluids from a leak source at a seabed as in claim 1, said containment vessel including a top with a plurality of flanged ports said flanged ports being configurable to be opened or closed.

6. system for controlling leakage of hydrocarbon fluids from a leak source at a seabed as in claim 5, said containment vessel including a closed bottom with a flanged fitting configured to attach to a well structure, said well structure comprising the leak source.

7. system for controlling leakage of hydrocarbon fluids from a leak source at a seabed as in claim 5, said containment vessel including an opened bottom with a flanged bottom end, said flanged bottom end being encapsulated in the pumped hydraulic concrete.

8. system for controlling leakage of hydrocarbon fluids from a leak source at a seabed as in claim 1, said containment vessel comprising a plurality of stacked sections and a top.

9. system for controlling leakage of hydrocarbon fluids from a leak source at a seabed as in claim 1, said closed loop containment barrier comprising a plurality of joined tiers.

10. A method for controlling leakage of hydrocarbon fluids from a leak source at a seabed, said method comprising steps of positioning a closed loop containment barrier around the leak source, said closed loop containment barrier defining a volume into which hydraulic concrete may be pumped, positioning a containment vessel over the leak source in the volume into which hydraulic concrete may be pumped, said containment vessel having an interior compartment into which hydrocarbon fluids may be captured and an exterior, pumping hydraulic concrete into the volume and filling at least a portion of said volume and encapsulating the exterior of at least a portion of the containment vessel; and providing a catenary gasket attached to the closed loop containment barrier, said catenary gasket comprising a flexible material that conforms to the shape of the seabed and defines a surface upon which the hydraulic concrete may be pumped and cured.

11. A method for controlling leakage of hydrocarbon fluids from a leak source at a seabed as in claim 10, further comprising filling said closed loop containment barrier with cement before positioning the closed loop containment barrier around the leak source.

12. method for controlling leakage of hydrocarbon fluids from a leak source at a seabed as in claim 10, said method further comprising providing a collar defining a central channel, said collar being concentric with the closed loop containment barrier and attached to the closed loop containment barrier by a plurality of elongated braces, and said containment vessel fitting within the collar.

13. A method for controlling leakage of hydrocarbon fluids from a leak source at a seabed as in claim 12, said method further comprising providing a catenary gasket attached to the closed loop containment barrier and the collar, said catenary gasket comprising a flexible material that conforms to the shape of the seabed and defines a surface upon which the hydraulic concrete may be pumped and cured, said catenary gasket not covering the channel of the collar.

14. method for controlling leakage of hydrocarbon fluids from a leak source at a seabed as in claim 10, said containment vessel including a top with a plurality of flanged ports said flanged ports being configurable to be opened or closed.

15. method for controlling leakage of hydrocarbon fluids from a leak source at a seabed as in claim 10, said containment vessel including a closed bottom with a flanged fitting configured to attach to a well structure, said well structure comprising the leak source.

16. method for controlling leakage of hydrocarbon fluids from a leak source at a seabed as in claim 10, said containment vessel including an opened bottom with a flanged bottom end, said flanged bottom end being encapsulated in the pumped hydraulic concrete.

17. method for controlling leakage of hydrocarbon fluids from a leak source at a seabed as in claim 10, said containment vessel comprising a plurality of stacked sections and a top.

18. method for controlling leakage of hydrocarbon fluids from a leak source at a seabed as in claim 10, said method said closed loop containment barrier comprising a plurality of joined tiers.

* * * * *